US007305065B2

(12) United States Patent
Takahashi et al.

(10) Patent No.: US 7,305,065 B2
(45) Date of Patent: Dec. 4, 2007

(54) X-RAY GENERATOR WITH VOLTAGE DOUBLER

(75) Inventors: Jun Takahashi, Nagareyama (JP); Hiroshi Takano, Moriya (JP)

(73) Assignee: Hitachi Medical Corporation, Kashiwa-Shi (JP)

( * ) Notice: Subject to any disclaimer, the term of this patent is extended or adjusted under 35 U.S.C. 154(b) by 16 days.

(21) Appl. No.: 10/556,794

(22) PCT Filed: May 14, 2004

(86) PCT No.: PCT/JP2004/006523

§ 371 (c)(1),
(2), (4) Date: Nov. 15, 2005

(87) PCT Pub. No.: WO2004/103033

PCT Pub. Date: Nov. 25, 2004

(65) Prior Publication Data

US 2006/0210020 A1 Sep. 21, 2006

(30) Foreign Application Priority Data

May 15, 2003 (JP) ..... 2003-136816

(51) Int. Cl.
*H05G 1/12* (2006.01)
*H05G 1/10* (2006.01)

(52) U.S. Cl. ..... 378/104; 378/101

(58) Field of Classification Search ..... 378/91, 378/101, 104, 105, 106, 107, 117, 118
See application file for complete search history.

(56) References Cited

U.S. PATENT DOCUMENTS 4,553,255 A * 11/1985 Kanerva ..... 378/110
4,601,051 A * 7/1986 Santurtun et al. ..... 378/118
4,700,372 A * 10/1987 Tsuchiya ..... 378/105
4,995,069 A * 2/1991 Tanaka ..... 378/200
5,023,768 A * 6/1991 Collier ..... 363/68
5,077,771 A * 12/1991 Skillicorn et al. ..... 378/102
5,231,564 A * 7/1993 Pellegrino et al. ..... 363/61
5,661,774 A * 8/1997 Gordon et al. ..... 378/101
6,563,717 B2 * 5/2003 Lunding et al. ..... 363/15
7,050,539 B2 * 5/2006 Loef et al. ..... 378/105

FOREIGN PATENT DOCUMENTS

JP 4-138700 A * 5/1992

* cited by examiner

*Primary Examiner*—Allen C. Ho
(74) *Attorney, Agent, or Firm*—Antonelli, Terry, Stout & Kraus, LLP.

(57) ABSTRACT

Between terminals of secondary windings in a high-voltage transformer (3), there are connected in parallel input side terminals of a plurality of diode full bridge circuits each via voltage maintaining means such as a capacitor maintaining a voltage peak value for a longer period than the cycle of an inverter (2). Between the input side terminals of the diode full bridge circuits, there are connected voltage maintaining means such as capacitors maintaining a voltage peak value for a longer period than the cycle of the inverter. Moreover, the output side terminals of the diode full bridges are connected in series via smoothing means such as almost equivalent smoothing capacitors and between the output side terminals, an anode grounding type X-ray tube (5) is connected. Thus, it is possible to realize a small-size and light-weight device at a reduced cost and reduce the ripple in the output voltage while using the anode grounding type X-ray tube.

9 Claims, 7 Drawing Sheets

X-RAY GENERATOR WITH VOLTAGE DOUBLER

TECHNICAL FIELD

The present invention relates to a high-voltage device wherein a high-voltage transformer is able to output severalfold of voltage. It particularly relates to an inverter type X-ray generator that converts a direct current (DC) power source into alternating current (AC) of high frequency by an inverter. It boosts the outputted voltage through a high-voltage transformer, generates DC high voltage by rectifying it, and applies it to an anode grounded X-ray tube.

BACKGROUND OF THE INVENTION

An X-ray generator is generally known as a device to generate X-rays to irradiate the diagnostic region of the body of a subject, and is comprised of an X-ray tube which irradiates X-rays and a high-voltage generator which generates high-voltage DC (hereinafter referred to as the tube voltage) to apply to said X-ray tube. The neutral grounded type has mainly been used for the stated X-ray generator. However, it has been difficult to accommodate the centrifugal force-resistant capacity in the anode roller bearing portion in the cases of achieving the anode heat capacity or adapting it to a CT device. Consequently an anode grounded X-ray tube has started to be used as well, in accordance with the increase in capacity and load factor of the X-ray generator as disclosed in JP-A-2002-164197. This anode grounded X-ray tube is configured in a way that the electric potential of an anode rotating rotor can be grounded, which increases the degree of freedom in designing the anode, making it possible to facilitate the designing for heat release, allowing for dramatically improved heat release efficiency. The mounting of a large number of X-ray tubes became possible as a result.

Patent Document 1: JP-A-2002-164197

However, using the inverter type high-voltage generator with the conventional anode grounded X-ray tube leaves us with no choice but to enlarge the size of its housing in order to withstand the voltage. The high-voltage generator with conventional anode grounded type was configured to hold the DC voltage of +75 kV maximum for the anode side, −75 kV maximum for the cathode side, with a total of 150 kV to be applied to an X-ray tube in response to the earth potential, thus required the designing to withstand ±75 kV maximum for the windings of a high-voltage transformer or for between the respective terminals and the earth potential of a high-voltage rectifier. On the other hand, in the case of using the anode grounded X-ray tube, the cathode side requires a maximum of −150 kV for grounding the anode side of the X-ray tube in response to the earth. Consequently, a design to withstand two times 75 kV is demanded, and the size of a high-voltage generator including a high-voltage transformer for an anode grounded X-ray tube or a high-voltage rectifier would have to be quite large.

Meanwhile in another document, Japanese Patent No. 2814016, the Cockcroft-Walton circuit is disclosed as a voltage multiplying circuit. The operation of the above-mentioned circuit will now be described using FIG. 3 of the above-mentioned document.

Patent Document 2: Japanese Patent No. 2814016

(1) In a cycle of the secondary coil in which the upper side becomes a positive, an electric current flows through diode 19, passing through capacitor 17 from above the second coil. At this time, the voltage −E(kV) which is at peak alternating voltage will be charged at both ends of capacitor 17.

(2) Next, in a cycle in which the polarity of alternating voltage reverses its course and the underside of the secondary coil turns to be a positive, a secondary current flows toward capacitor 21 from underneath. Capacitor 21 is charged by −E (kV), and the electric current returns to the secondary coil, passing through diode 18 and capacitor 17. At this time, the electric current, passing through diode 18, is backed up by −E(kV) which was maintained within said capacitor 17. As a result, −2E(kV), a total of −E(kV) which was generated in the secondary coil and the voltage −E(kV) which was in capacitor 17, is generated between both ends of capacitor 21.

(3) Moreover, in a cycle in which the polarity of alternating current is reversed and the upper side of the secondary coil becomes a positive again, an electric current flows in a same manner as (1), and −E(kV) in capacitor 17 which started to fall will be maintained.

(4) Moreover, in a cycle in which the polarity of the alternating current reverses and the underside of the secondary coil becomes a positive again, −2E(kV) is generated totaling −E(kV) which was generated in the secondary coil and −E(kV) which was stored in capacitor 17 as described in (3) between the earth and the upper side of the secondary coil. At this point −2E(kV) has already been generated as described in (2) at both ends of capacitor 21. In this way the cathode potential of the X-ray tube is stabilized at −2E(kV). Furthermore, on and after (2), electricity is constantly discharged by the X-ray tube after the voltage received at both ends of the X-ray tube reaches a certain level. The voltage that capacitor 21 receives is generally around −150 kV at this point, which requires capacitor 21 to be quite large in size. Additionally, notable ripples are included in the voltage drop curved line on both ends of the X-ray tube at the time of discharge.

The purpose of this invention is to offer an inverter type X-ray generator that allows for small-size and light-in-weight configuration at a reduced cost even with usage of the anode grounded X-ray tube operated with high voltage, and is able to reduce the ripples during discharge.

DISCLOSURE OF THE INVENTION

In order to accomplish the purpose mentioned above, according to the first feature of the present invention, in the X-ray generator including: a high-frequency output means that outputs alternating current at high frequency; a high-voltage transformer being connected to the output side of mentioned high-frequency output means and that boosts the output of mentioned high-frequency output means; a voltage doubling means that multiplies the high-voltage output of mentioned high-voltage transformer; and an anode grounded X-ray tube of which the high-voltage DC generated by mentioned voltage doubling means is applied; a high-frequency rectifying circuit is included in mentioned voltage doubling means.

According to the second feature of the present invention, in the X-ray generator based on the first feature, said voltage doubling means includes voltage maintaining means that maintains a peak of the voltage between the nodes in a high-frequency rectifying circuit for a longer period of time than the cycle of high-frequency output means.

According to the third feature of the present invention, in the X-ray generator based on the first and second feature, the high-frequency rectifying circuit is configured in a way that connects at least two diode full bridges.

According to the fourth feature of the present invention, in the X-ray generator based on the first through third feature, said voltage maintaining means is at least connected to said high-frequency rectifying circuit.

According to the fifth feature of the present invention, in the X-ray generator based on the first through fourth feature, a smoothing means is additionally mounted in said voltage doubling means.

According to the sixth feature of the present invention, in the X-ray generator based on the fifth feature, said high-frequency rectifying circuit is configured in a manner that the input terminals of at least two diode full bridges are connected together in parallel by polarity, voltage maintaining means is comprised of the first voltage maintaining means and the second voltage maintaining means, said first voltage maintaining means is inserted into each spacing between the parallel-connected wirings, said smoothing means is connected in between two output terminals of at least two diode full bridges, and said second voltage maintaining means is connected in between said high-frequency output means and said high-frequency rectifying circuit.

According to the seventh feature of the present invention, in the X-ray generator based on the sixth feature, said one second voltage maintaining means is inserted into at least one of the wirings between the output side of said high-voltage transformer and the input side of said high-frequency rectifying circuit.

According to the eighth feature of the present invention, in the X-ray generator based on the sixth feature, said second voltage maintaining means is inserted into the input side of said high-voltage transformation means.

According to the ninth feature of the present invention, in the X-ray generator based on the first through the eighth feature, the tube voltage detection means is additionally connected to the output side of said voltage doubling means.

According to the tenth feature of the present invention, in the X-ray generator based on the first through ninth feature, said high-frequency output means is comprised of a direct-current power source and an inverter circuit.

BEST MODE FOR CARRYING OUT THE INVENTION

Hereinafter, the preferred embodiments of display means as well as the device of the functional images related to the present invention will be described according to the attached drawings.

Figure 1:
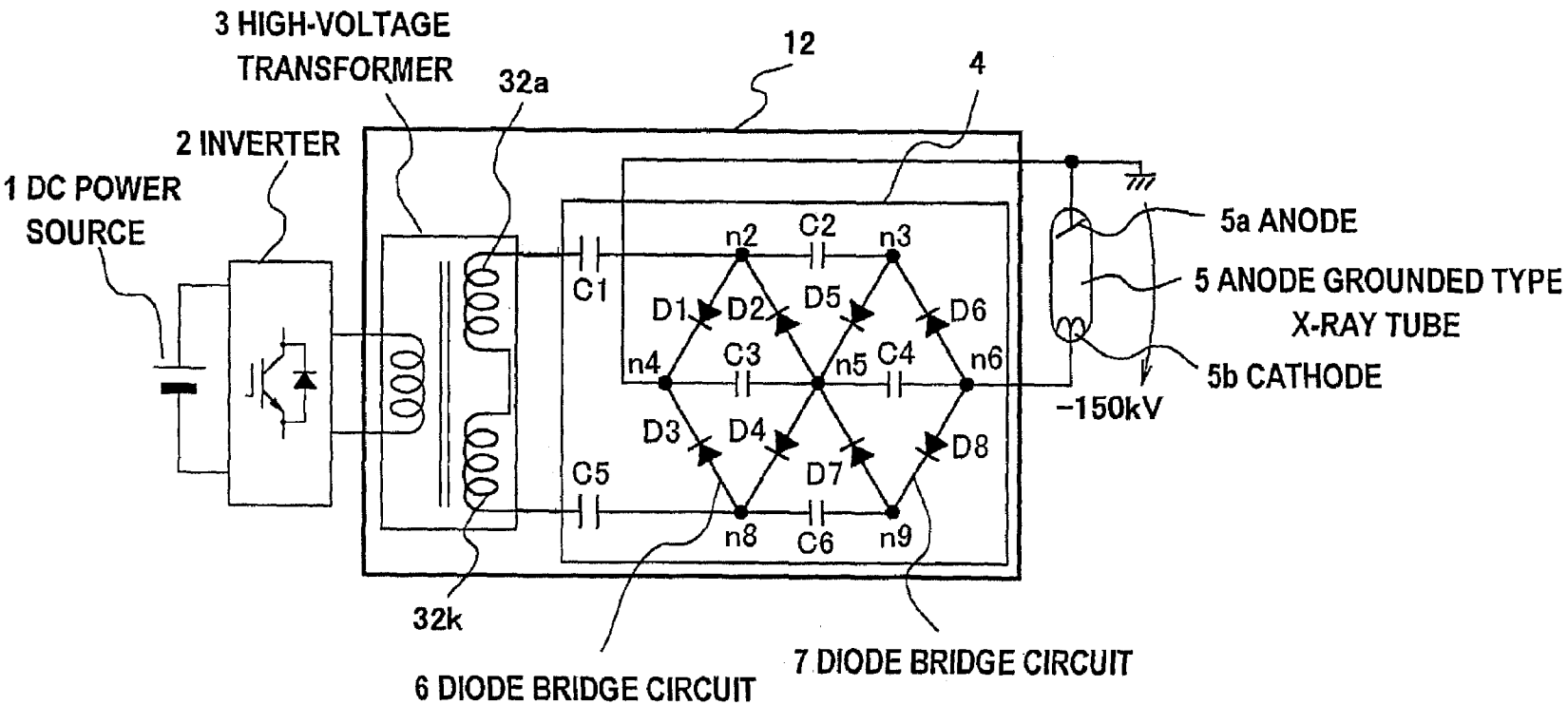
FIG. 1 is a circuit diagram showing the inverter type X-ray generator in one embodiment of the present invention.

FIG. 1 is a circuit diagram showing the inverter type X-ray generator in the first embodiment of the present invention. It is configured in a manner that the DC voltage in DC power source 1 is converted into AC voltage of high frequency using inverter 2, boosting the output voltage thereof by high-voltage transformer 3, then anode 5*a* as well as cathode 5*b* are connected to the output side of voltage doubling means 4 which is connected to the output side of high-voltage transformer 3, the high-voltage DC is delivered to anode grounded X-ray tube 5, and the X-ray is eradiated. High-voltage generator 12 is comprised of high-voltage transformer 3 and voltage doubling means 4. Although the device used with the inverter is described here, it goes without saying that the other means can be applied as long as it is a device that generates the AC power of high frequency.

DC power resource 1 described above is a means to provide DC voltage. Examples of possible DC power source 1 are as follows; a battery, means to obtain DC voltage by rectifying commercial electric power of commercial power source that is 50 Hz or 60 Hz of the alternating current and by smoothing with smoothing means such as a capacitor, as well as a high-power factor converter that has a boosting function applying, for example, IGBT. The rectification for the electric power of the above-mentioned commercial power source is made possible by a rectifying circuit such as a diode or a thyristor.

Inverter 2 receives DC voltage outputted from DC power source 1 and converts it into high-frequency AC voltage. It also controls to set the tube voltage that is outputted from high-voltage generator 12 and applied to the X-ray tube, to be a targeted value. For example, it is controlled with an inverter controlling circuit to set the tube voltage as a targeted value.

Figure 2A:
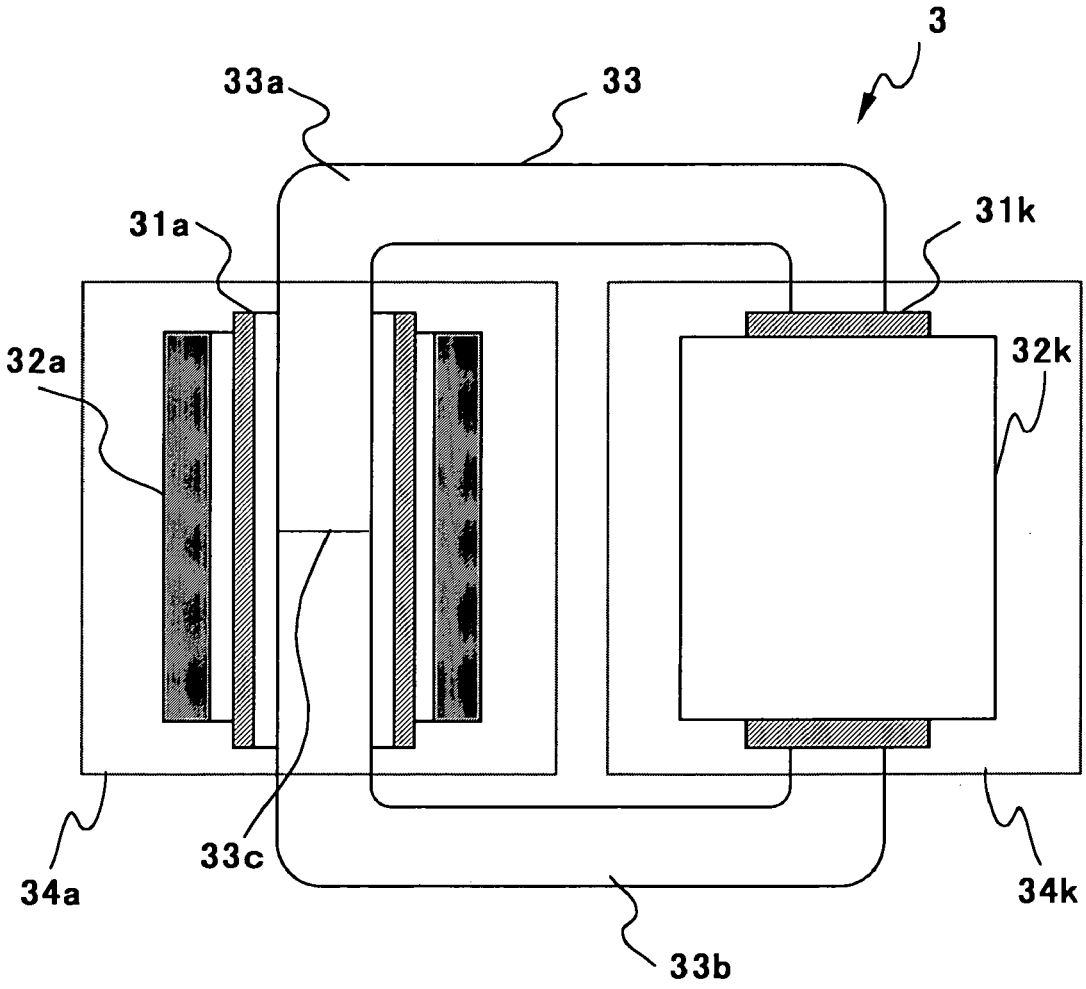
FIG. 2*a* is a front view of a partial cross section showing the high-voltage transformer in the inverter type X-ray generator shown in FIG. 1.
Figure 2B:
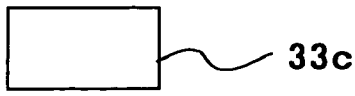
FIG. 2*b* is a cross sectional view of 33*c* in FIG. 2*a*.

Also, high-voltage transformer 3 boosts the AC voltage from inverter 2, and the primary winding is connected to the output side of inverter 2. The configuration of the above-mentioned primary winding will now be described referring to FIG. 2. From necessity to accommodate sufficient current capacity and a huge amount of electric power with high frequency, first primary winding 31*a* and second primary winding 31*k* have bi-parallel format winding respectively around two legs 34*a* and 34*k* of U-U type cut core 33. U-U type cut core 33, for example, is a ring-shaped cut core 33 being one U-type cut core 33*a* joined on the other U-type cut core 33*b*, and joint portion 33*c*, for example, is a cross-sectional and square-shaped as seen in FIG. 2*b*. At the same time, secondary windings 32*a* and 32*k* are wound around each of primary windings 31*a* and 31*k* and respectively generate half of the amount of the tube voltage.

Voltage doubling means 4 receives the outputted high voltage of high frequency from high-voltage transformer 3 and converts it into direct current. It connects voltage maintaining means such as capacitor C1, C5 and so forth that keeps the voltage peak for a longer period of time than the cycle pulsed respectively in inverter 2, to the spacing between the terminals of secondary windings 32*a* and 32*k* in high-voltage transformer 3. The terminals of secondary windings 32*a* and 32*k* are connected to the input terminals of diode full bridge circuits 6 and 7 through mentioned voltage maintaining means. The input terminal of mentioned diode full bridge circuit 6 has two poles, node n2 and node n8, and the input terminal of diode full bridge circuit 7 has two poles, node n3 and node n9. One terminal of each of secondary windings 32*a* and 32*k* is connected to one terminal side of two diode full bridge circuits. Also, the other terminal of each of secondary windings 32*a* and 32*k* is connected to the other polarity side of two diode full bridge circuits. In other words, one end each of secondary winding 32*a* and secondary winding 32*k* are connected, and the other end of secondary winding 32*a* is connected to capacitor C1, and on to nodes n2 and n3 that are on one polar side of the input terminal in diode full bridge circuit 6. Also the other end of secondary winding 32*k* is connected first to capacitor C5 and then to nodes n8 and n9 that are on the other polarity side of the input terminal in diode full bridge circuit 6.

Furthermore, voltage maintaining means such as capacitor C2 that maintains the voltage peak for a longer period of time than the cycle of inverter 2 is connected to the spacing between nodes n2 and n3 which is one polarity side of the input terminal. In the same way, voltage maintaining means such as capacitor C6 that maintains the voltage peak for a longer period of time than the cycle of inverter 2 is connected to the spacing between node n8 and node n9 which is the other polarity side of the input terminal.

Moreover, respective diode full bridges 6 and 7 are connected in series on the output side. In other words, node n5 of respective diode full bridge 6 and 7 are connected together, and output terminal n4 of diode full bridge circuit 6 and output terminal n6 of diode full bridge circuit 7 are connected to the respective anode 5*a* and cathode 5*b* of anode grounded X-ray tube 5.

Anode grounded X-ray tube 5 inputs DC output voltage from voltage doubling means 4 and radiates X-rays, and is comprised of cathode 5*b* that generates thermal electrons and anode 5*a* that generates X-rays by which the thermal electrons from mentioned cathode 5*b* are being crashed, and to which anode 5*a* is grounded.

The difference between the Cockcroft-Walton circuit published in Japanese Patent Document No. 2814016, and the voltage doubling device related to the present invention will now be described. In the case of the Cockcroft-Walton circuit, because it charges only once in a cycle to capacitor 21 that is connected in parallel for outputting, the ripple ratio of the X-ray tube voltage, i.e. the margin of fluctuation from the reference tube voltage is increased. In order to decrease the ripple ratio of the X-ray tube voltage, a means to charge the capacitor once every half a cycle, which gives more frequency, is desirable. Moreover, the inverter type high-voltage generator exercising a neutral grounded X-ray tube which is like the one and shown in FIG. 8 had the advantages of being small in size, reduced in cost, and had increased latitude for insulation designing of the high-voltage device as a whole, for the maximum voltage generated in the circuit of the device was +−75 kV. Consequently, in order to reduce the maximum voltage and the ripple ratio of mentioned tube voltage at the same time, the inventor had devised the circuit that exercises the charging to the capacitor each time the polarity of the output power in the high-voltage transformer switches over. A simulation described below was executed for the purpose of examining the details and improving the configuration of the circuit.

The software used for this simulation is a commonly used kind, called SPICE, that is able to carry out the electric circuit analysis. The simulation will now be described referring to FIG. 1. As the circuit elements, full bridge inverter 2 (20 kHz, DC700V), high-voltage transformer 3 (the turn ratio varies from 100 to 200), anode grounded X-ray tube 5 (around 200Ω as 500 mA of 100 kV), as well as diode full bridge circuits D1 to D8, C3 to C4 (the four diodes are bridge-connected and the capacitor is inserted into the center), are connected in the range of two to four steps in plural and parallel manner. Moreover voltage maintaining capacitors C1, C2, C5 and C6 were appropriately added for the purpose of generating the multiplying voltage. As a result of setting up the conditions, configuring the circuits, and executing the simulation, some beneficial effects mentioned below were acknowledged.

(1) The ripple ratio of the tube voltage would not be influenced very much by the number of steps, therefore two steps would be sufficient.
(2) The voltage can be multiplied in proportion to the number of steps mentioned above for the diode full bridge circuits of the tube voltage.
(3) The rising time of the tube voltage increases as the number of steps grows.
(4) Because the voltage is low in the circuit other than the area in the proximity of the output portion connected to the X-ray tube, which is a condition similar to the inverter type generator using the neutral grounded X-ray tube, it is possible to use a capacitor with reduced size, cost, and capacity, and also the neutral grounded type can be diverted for the insulation designing of the whole device.
(5) If the circuit has two steps, it is possible to apply the full bridge diode module that is being used with the neutral grounded type.

From the results mentioned above, for the configuration of the inverter type X-ray generator using the anode grounded X-ray tube, it was ascertained that to provide two steps of diode full bridge circuits would be the most desirable.

The advantages over designing to withstand voltage for the X-ray generator related to the present invention will furthermore be described with specific examples. If we attempt to design the inverter type X-ray generator for the anode grounded X-ray tube with the same design concept for the inverter type X-ray generator for conventional neutral grounded X-ray tubes described in FIG. 3*a*, the configuration will be such as shown in FIG. 3*b*. In other words, in the neutral grounding shown in FIG. 3*a*, the neutral grounded X-ray generator was configured in a way that the respective input terminals of high-voltage rectifying circuits 4*a* and 4*b* are connected to secondary windings 3*a* and 3*b* of high-voltage transformer 3, grounded in the spacing between high-voltage rectifying circuits 4*a* and 4*b* to which the output terminals were connected in series, as well as X-ray tube 5 is connected to the spacing between high-voltage rectifying circuits 4*a* and 4*b*. On the contrary, the present invention allows for the configuration of the anode grounded X-ray generator, by stopping the grounding in the connecting portion of secondary windings 3*a* and 3*b*, and by connecting X-ray tube 5 to the spacing between terminals 3*a* and 3*b* of secondary windings, as well as grounding anode-a side.

Figure 3A:
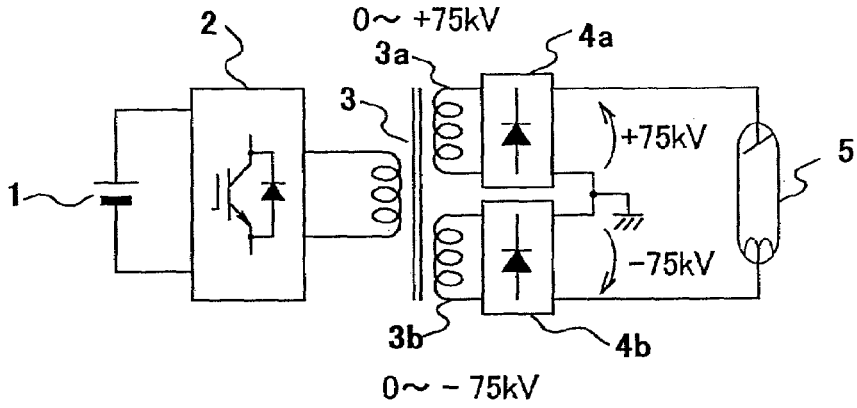
FIG. 3*a* is a diagram showing the structure of the inverter type X-ray generator for conventional neutral grounded X-ray tube.
Figure 3B:
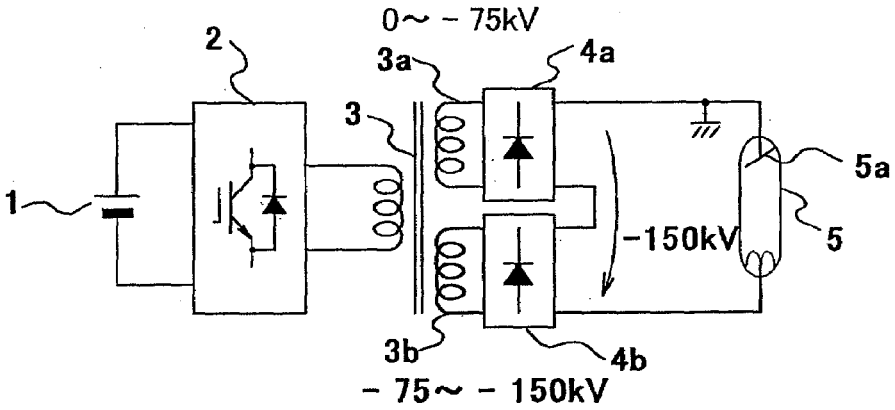
FIG. 3*b* is a schematic view showing a structure of the inverter type X-ray generator for the anode grounded X-ray tube related to the present invention.
Figure 4:
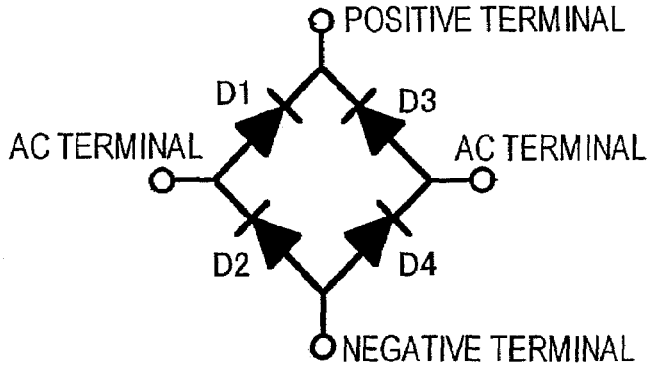
FIG. 4 is a circuit diagram showing the diode full bridge circuit.

With the neutral grounded high-voltage generator, as shown in FIG. 3*a*, the voltage potential difference generated in the spacing between secondary windings 3*a* and 3*b* of high-voltage transformer 3 at the time of applying 150 kV to X-ray tube 5 is ±75 kV each. However, in conventional X-ray generators for the anode grounded X-ray tube, shown in FIG. 3*b*, the voltage potential difference generated in the spacing between secondary windings 3*a* and 3*b* of high-voltage transformer 3 would be a maximum of −150 kV. Consequently the need, for example, to use an elemental device such as a capacitor with high capacity for withstanding voltage, or allowing more space for insulation between the inner surface and the high-voltage tank which stores high-voltage generator 12, will arise, and therefore increasing the size of high-voltage transformer 3 itself will be unavoidable.

In the present invention, voltage maintaining means such as capacitor C1, C2, C5, and C6 that maintain the voltage peak for a longer period of time than the cycle of inverter 2 and smoothing means such as smoothing capacitor C3 and C4 are added to voltage doubling means 4 in high-voltage generator 12 shown in FIG. 1. The above-configured diode full bridge circuits 6 and 7 are made up of full-wave voltage multiplying circuits with two steps. For example, in the case of applying 150 kV to anode grounded X-ray tube 5, the maximum voltage potential difference between the secondary side terminals of high-voltage transformer would be 75 kV, but it is possible to double the voltage to 150 kV as an output of voltage doubling means 4 by its boosting function. Also, if node n4 in the voltage doubling means is grounded here, node n4 would have the same electric potential as the anode 5*a* side of anode grounded X-ray tube 5. In other words, on the occasion when the voltage of 150 kV is rectified in voltage doubling means 4, a basing point of the rectification thereof is set on the intermediate voltage 75 kV in node n4. Thus the secondary terminal of voltage transformer 3 operates in the range of maximum +−75 kV, which is half the voltage of the maximum tube voltage corresponding to the earth. Consequently in high-voltage generator 12, it is sufficient to design the device to withstand ±75 kV to correspond to the earth potential. As described above, designing to withstand voltage for the X-ray generator using the anode grounded X-ray tube relating to the present invention requires only about the same voltage as using the conventional neutral grounded type.

Next, the advantages of the circuit element diversion for the X-ray generator relating to the present invention will now be described. In conventional neutral grounded X-ray device shown in FIG. 8, secondary winding 3*a* of high-voltage transformer 3 is connected to the spacing between AC input terminals 6*a* and 7*a* of diode full bridge circuit module 4*a*, secondary winding 3*b* is connected to the spacing between AC input terminals 6*b* and 7*b* of diode full bridge circuit module 4*b*, positive output terminal 8*b* of diode full bridge circuit module 4*b* is connected to negative output terminal 9*a* of diode full bridge circuit module 4*a* and grounded, and X-ray tube 5 is connected between positive output terminal 8*a* of diode full bridge circuit module 4*a* and negative output terminal 9*b* of diode full bridge circuit module 4*b*. Based on the above-mentioned configuration, it is possible to configure voltage doubling means shown in FIG. 1, by altering the connection of diode full bridge circuit module 4*a* and 4*b*, that are modularized full-wave rectifying circuits, each consisting of four diodes.

In other words, 7*a* and 6*b* are connected, and a peak-voltage maintaining capacitor is interposed in 6*a*. Moreover, 6*a* is extended to the intersection of D5 and D6, and the other peak-voltage maintaining capacitor is also interposed there. Additionally, the peak-voltage maintaining capacitor is interposed in 7*b*, 7*b* is extended to the intersection of D3 and D4, and the other peak-voltage maintaining capacitor is also interposed there. Furthermore, by removing the earth between 9*a* and 8*b*, it is possible to convert the device into the anode grounded X-ray generator, the same as shown in FIG. 1. In the case of applying 150 kV to X-ray tube 5 with the above configuration, since the withstand voltage of the discrete of each individual diode D1 through D8 is +−75 kV, if the same diode full bridge circuit module 4*a* and 4*b* as the one used for the conventional neutral grounded X-ray generator shown in FIG. 8 are applied, the withstand voltage of the discrete diode D1 though D8 would be 75 kV, which is possible to be used directly from the viewpoint of withstand voltage.

Figure 5:
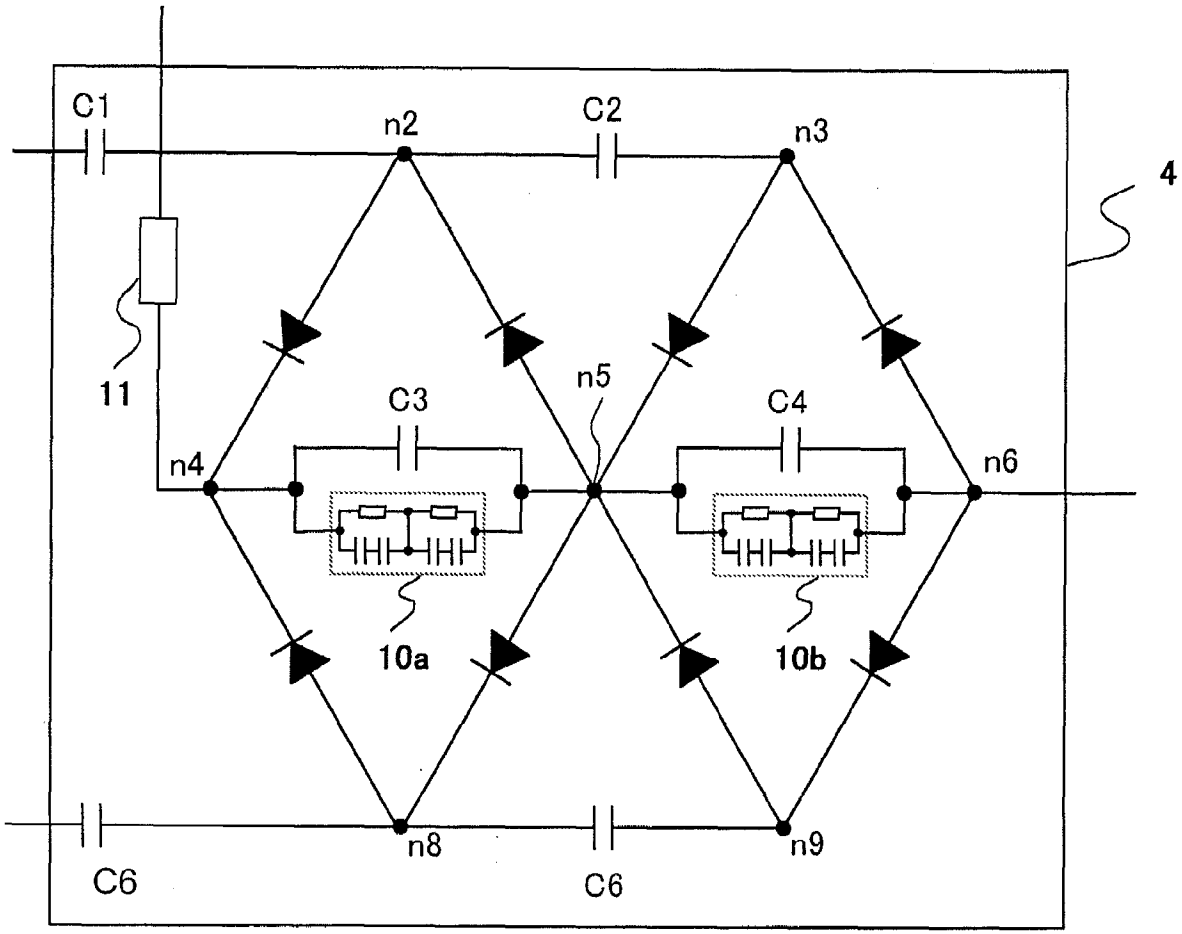
FIG. 5 is a circuit diagram showing the configuration of the voltage doubling means including the tube voltage detection device related to the present invention.

Furthermore, for diode full bridge circuit modules 4*a* and 4*b*, the configuration of the conventional neutral grounded X-ray generator can be applied, which includes voltage dividers 10*a* and 10*b* that are used along with tube voltage detecting resistance 11 in order to detect tube voltage as shown in FIG. 5.

Figure 8:
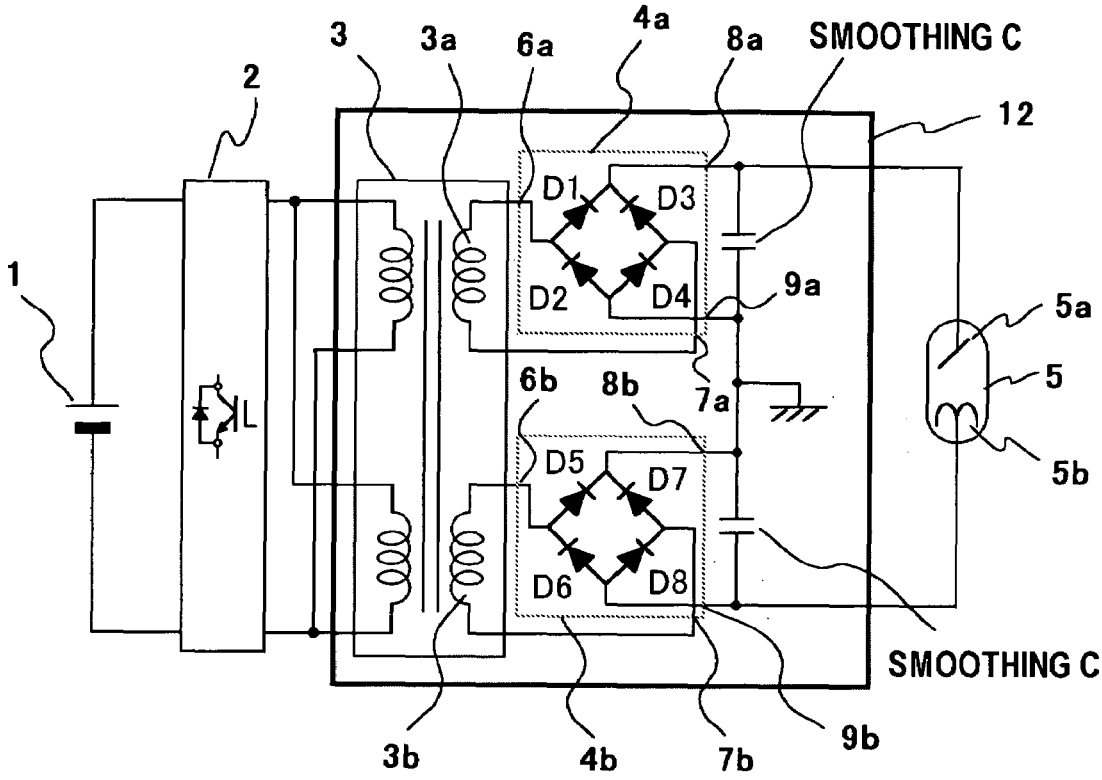
FIG. 8 is a circuit diagram showing a conventional neutral grounded inverter type X-ray generator.

As stated above, it is possible to use a sizable percentage of circuit elements that are used as neutral grounded type as shown in FIG. 8 directly as the elements of the present invention, and therefore unnecessary, for instance, to arrange new elements. Moreover, as diode full bridge circuit modules 4*a* and 4*b* configure voltage doubling means 4, it is possible for them to be shared between the neutral grounded type and the anode grounded type, and also to provide the X-ray generator at a reduced cost without changing many of the existing manufacturing facilities or the arrangement of the parts.

Also, the inverter circuit using the full-wave multiplying circuit relating to the present invention, even in comparison with the boosting circuit of the half-wave rectification like the Cockcroft-Walton circuit, is characterized by the fact that the capacity of the capacitor is small and is able to reduce the ripples in the tube voltage, thus it is possible to reduce its size and weight as small as the neutral grounded X-ray generator.

Embodiment 2

Figure 6:
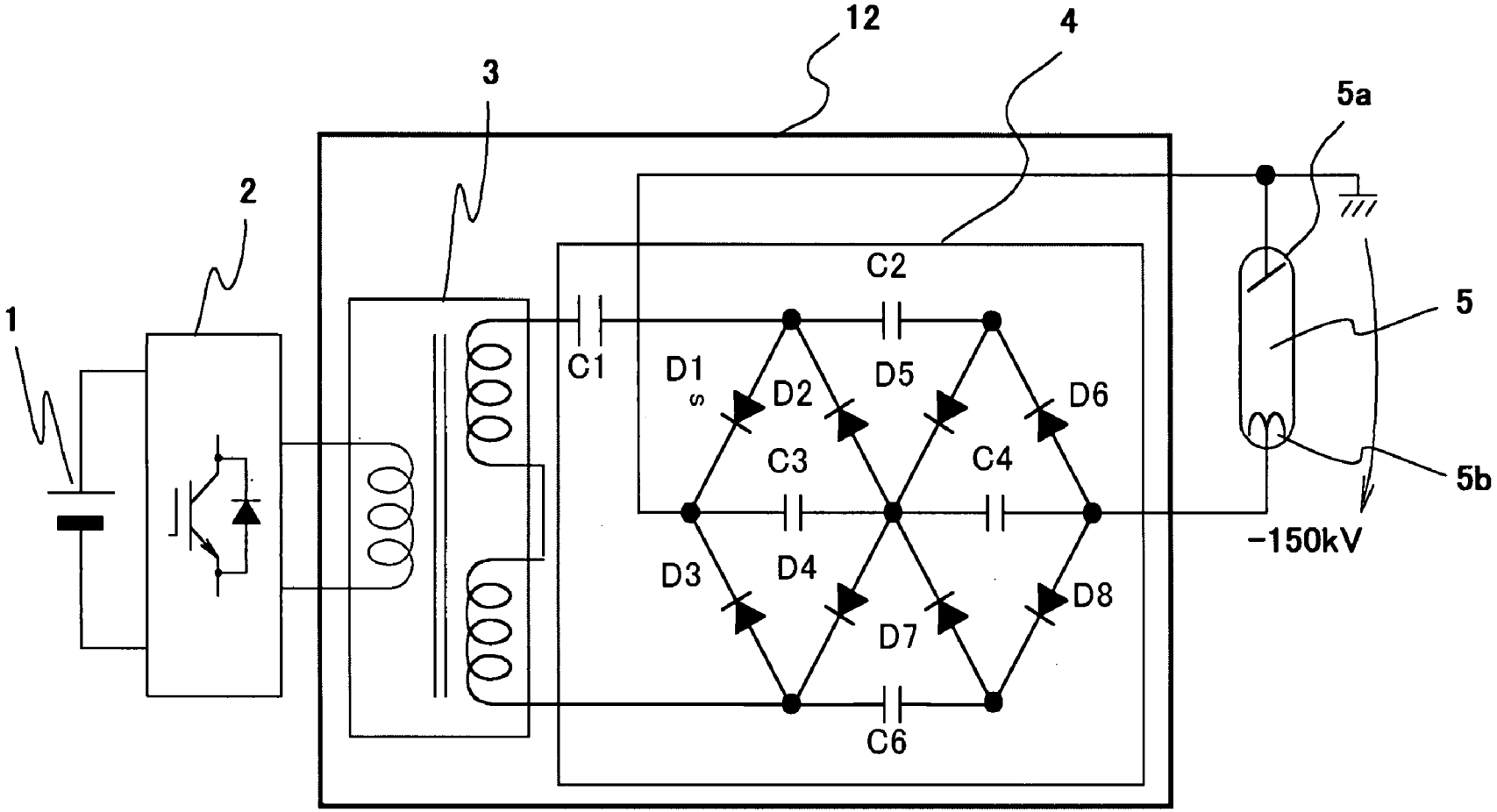
FIG. 6 is a circuit diagram showing the inverter type X-ray generator in the other embodiment of the present invention.

FIG. 6 is a circuit diagram showing the inverter system X-ray generator according to embodiment 2. For the equivalent with embodiment 1, the detailed explanation will be omitted, with encoding remaining the same. The inverter type X-ray generator according to the mode of the present embodiment, comprises of voltage maintaining means that omits capacitor C5 which was connected between secondary winding 32*k* and voltage doubling means 4 in high-voltage transformer 4 as shown in FIG. 1 and maintains the voltage peak for a longer period of time than the cycles of inverter 2 by the other capacitors C1, C2, and C6. This is equivalent electric circuit-wise to the mode of the embodiment shown in FIG. 1, thus enabling further reduction in size and cost by reducing the number of capacitors. This kind of configuration is especially helpful in the case of space for installation being limited.

Embodiment 3

Figure 7:
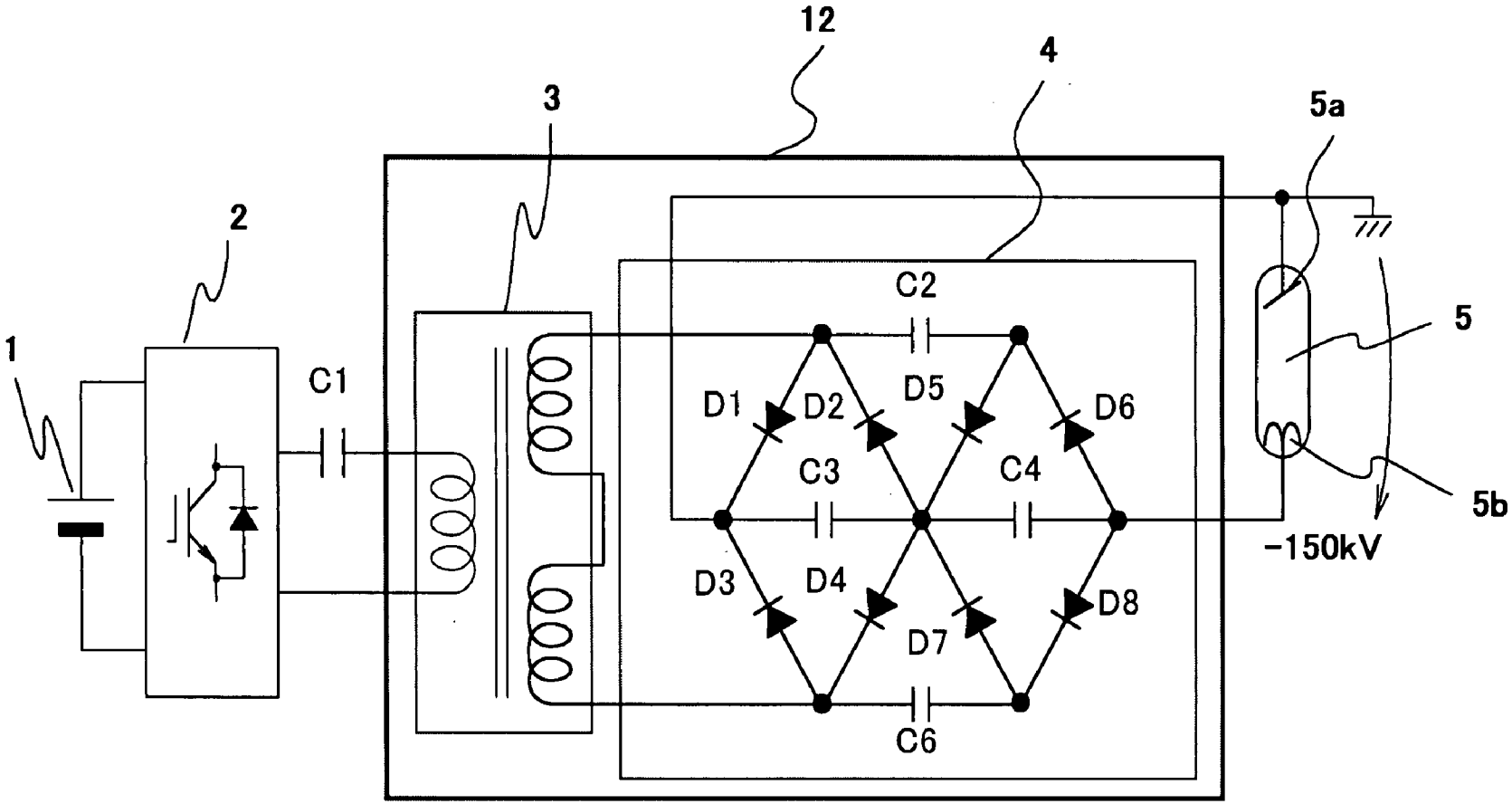
FIG. 7 is a circuit diagram showing the inverter type X-ray generator in another embodiment related to the present invention.

FIG. 7 is a circuit diagram showing the inverter type X-ray generator according to embodiment 3. For the equivalent with the embodiment 1, the detailed explanation will be omitted, with encoding remaining the same. In the inverter type X-ray generator according to the present embodiment, secondary windings 32*a* and 32*k* of high-voltage transformer 3 and voltage doubling means 4 shown in FIG. 1 are directly connected by omitting capacitor C1 and C5 that were connecting them, capacitor 1 is alternatively connected to the primary side of high-voltage transformer 3, and it configures the voltage maintaining means that maintains the voltage peak for a longer period of time than the cycle of inverter 2. This is equivalent electric circuit-wise to the mode of the embodiment shown in FIG. 1. In this embodiment, it is possible to install the capacitor that maintains the voltage peak on the primary side of the high-voltage transformer, and thus able to improve the latitude for designing the X-ray generation device.

Embodiment 4

Even though the X-ray generation device for the anode grounded X-ray tube has been described in embodiment 1 through 3, it is possible to apply the voltage doubling device relating to the present invention to the other technical fields. For example, it can be applied to an electronic microscope that requires high voltage. Despite its small size and weight, it can generate voltage manifold of its source, with stability and reduced voltage variation.

The invention claimed is:

1. An X-ray generator including:

high-frequency output means for outputting high frequency AC;

high-voltage transformation means for boosting the output of said high-frequency output means, being connected to the output side of said high-frequency output means;

voltage doubling means for doubling high-voltage output of said high-voltage transformation means;

an anode grounded X-ray tube for high-voltage DC generated in said voltage doubling means to be applied; and a high-frequency rectification circuit is included in said voltage doubling means;

wherein said high frequency rectification circuit includes only two diode full bridges.

2. An X-ray generator according to claim 1, wherein said voltage doubling means comprises voltage maintaining means that maintains the voltage peak between nodes in said high-frequency rectification circuit for a longer period time than the cycle of said high-frequency output means.

3. An X-ray generator according to claim 1, wherein a voltage maintaining means is connected to at least said high-frequency rectification circuit.

4. An X-ray generator according to claim 1, wherein a smoothing means is provided in said voltage doubling means.

5. An X-ray generator according to claim 4, wherein:

said high-frequency rectification circuit is configured so that input terminals of the only two diode full bridges are connected together by wirings in parallel with respect to each terminal;

said voltage maintaining means is comprised with first voltage maintaining means and second voltage maintaining means;

said first voltage maintaining means is respectively inserted into the spacing between said wirings connected in parallel;

said smoothing means is connected to the spacing between two output terminals of the only two diode full bridges; and said second voltage maintaining means is connected between said high-frequency output means and said high-frequency rectification means.

6. An X-ray generator according to claim 5, wherein said second voltage maintaining means is inserted into at least one of an output side of said high-voltage transformer and an input side of said high-frequency rectification circuit.

7. An X-ray generator according to claim 5, wherein one of said second voltage maintaining means is inserted into an input side of said high-voltage transformation means.

8. An X-ray generator according to claim 1, wherein tube voltage detection means is additionally connected to an output side of said voltage doubling means.

9. An X-ray generator according to claim 1, wherein said high-frequency output means is configured of a DC power source and an inverter circuit.

* * * * *